US010203088B2

(12) United States Patent
Lay et al.

(10) Patent No.: US 10,203,088 B2
(45) Date of Patent: Feb. 12, 2019

(54) DIRECT AND BACK VIEW LED LIGHTING SYSTEM

(75) Inventors: James Michael Lay, Apex, NC (US); Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 517 days.

(21) Appl. No.: 13/459,453

(22) Filed: Apr. 30, 2012

(65) Prior Publication Data

US 2012/0327650 A1 Dec. 27, 2012

Related U.S. Application Data

(60) Provisional application No. 61/501,540, filed on Jun. 27, 2011.

(51) Int. Cl.
*F21V 13/04* (2006.01)
*F21V 29/74* (2015.01)
(Continued)

(52) U.S. Cl.
CPC ..... *F21V 13/04* (2013.01); *F21V 29/745* (2015.01); *F21V 29/75* (2015.01); *F21V 29/777* (2015.01);
(Continued)

(58) Field of Classification Search
CPC ..... F21V 3/0445; F21V 3/0427; F21V 3/049; F21V 9/00; F21V 9/16; F21V 5/007
(Continued)

(56) References Cited

U.S. PATENT DOCUMENTS 3,409,770 A * 11/1968 Clapham, Jr. ..... C09K 11/04 250/462.1
4,338,653 A * 7/1982 Marrero ..... F21S 8/037 362/147
(Continued)

FOREIGN PATENT DOCUMENTS

EP 1182395 A2 2/2002
JP H08162677 A 6/1996
(Continued)

OTHER PUBLICATIONS

Cree, Inc., International Patent Application No. PCT/US2012/043234, International Search Report and Written Opinion, dated Oct. 3, 2012.
(Continued)

*Primary Examiner* — Sharon E Payne
(74) *Attorney, Agent, or Firm* — Myers Bigel, P.A.

(57) ABSTRACT

A direct and back view LED lighting system is disclosed. Embodiments of a lighting system and example light fixture are described. LED devices provide the light source. The LED devices can be positioned with a heatsink at or near the top of the system proximate to a back reflector. In example embodiments, the LED devices emit light downward. The system can be used in a troffer style fixture with a support structure and a pan. The system or fixture can have a lens arrangement including lenses, lens plates or sections with differing optical characteristics, including a partially reflective lens plate or section that passes and diffuses some light from the LED light source, but reflects some light back to the back reflector. Additional lenses or lens plates serve as diffusers.

25 Claims, 5 Drawing Sheets

(51) Int. Cl.
*F21V 29/75* (2015.01)
*F21V 29/77* (2015.01)
*F21Y 115/10* (2016.01)
*F21Y 113/13* (2016.01)

(52) U.S. Cl.
CPC ..... *F21Y 2113/13* (2016.08); *F21Y 2115/10* (2016.08); *Y10T 29/49826* (2015.01)

(58) Field of Classification Search
USPC ..... 362/231, 84, 311.01, 311.02, 147, 148
See application file for complete search history.

(56) References Cited

U.S. PATENT DOCUMENTS 5,130,761 A * 7/1992 Tanaka ..... F21S 48/215 257/100
5,530,628 A 6/1996 Ngai
5,688,042 A 11/1997 Madadi et al.
6,042,251 A * 3/2000 McCarthy et al. ..... 362/308
6,250,780 B1 * 6/2001 Minissi et al. ..... 362/364
6,853,151 B2 2/2005 Leong et al.
6,860,628 B2 3/2005 Robertson et al.
6,936,968 B2 8/2005 Cross et al.
7,048,410 B2 5/2006 Kutler
7,049,761 B2 5/2006 Timmermans et al.
7,114,830 B2 10/2006 Robertson et al.
7,213,940 B1 5/2007 Van De Ven et al.
7,300,191 B2 * 11/2007 Oshio et al. ..... 362/545
7,307,391 B2 12/2007 Shan
7,510,299 B2 3/2009 Timmermans et al.
7,744,242 B2 * 6/2010 Kramer ..... 362/231
7,815,338 B2 10/2010 Siemiet et al.
7,926,975 B2 4/2011 Siemiet et al.
7,976,196 B2 7/2011 Ivey et al.
8,058,659 B2 11/2011 Bisberg
8,093,823 B1 1/2012 Ivey et al.
8,115,411 B2 2/2012 Shan
8,118,447 B2 2/2012 Simon et al.
8,247,985 B2 8/2012 Timmermans et al.
8,282,247 B2 10/2012 Ivey et al.
8,324,817 B2 12/2012 Ivey et al.
8,360,599 B2 1/2013 Ivey et al.
8,362,710 B2 1/2013 Langovsky
8,382,327 B2 2/2013 Timmermans et al.
8,419,223 B2 4/2013 Withers
8,421,366 B2 4/2013 Palazzolo et al.
8,449,137 B2 5/2013 Dassanayake et al.
8,482,212 B1 7/2013 Ivey et al.
8,573,813 B2 11/2013 Ivey et al.
8,596,813 B2 12/2013 Ivey
8,764,225 B2 * 7/2014 Narendran et al. ..... 362/231
8,827,487 B2 * 9/2014 Farmer ..... F21V 5/00 362/223
2002/0060526 A1 5/2002 Timmermans et al.
2008/0285267 A1 * 11/2008 Santoro ..... F21V 5/02 362/224
2009/0103296 A1 4/2009 Harbers et al.
2011/0033635 A1 * 2/2011 Nishimoto et al. ..... 427/551
2011/0075410 A1 * 3/2011 Negley ..... F21K 9/00 362/231

FOREIGN PATENT DOCUMENTS

WO 20080152576 A1 12/2008
WO 20090125314 A2 10/2009
WO 2010099755 A1 9/2010
WO 2011037877 A1 3/2011

OTHER PUBLICATIONS

U.S. Appl. No. 29/467,949, filed Sep. 25, 2013.
U.S. Appl. No. 13/943,152, filed Jul. 16, 2013.
European Patent Office; Office Action for Application No. 12742974.4 dated Jul. 2, 2015, 6 Pages.
Cree, Inc., European Patent Application No. 12742974.4, Office Action, dated Feb. 11, 2016.

* cited by examiner

DIRECT AND BACK VIEW LED LIGHTING SYSTEM

CROSS-REFERENCE TO RELATED APPLICATION

This application claims priority from co-pending, commonly assigned provisional patent application Ser. No. 61/501,540, filed Jun. 27, 2011, the entire disclosure of which is hereby incorporated herein by reference

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. In many applications, one or more LED dies (or chips) are mounted within an LED package or on an LED module, which may make up part of a lighting unit, lamp, "light fixture" or more simply a "fixture," which includes one or more power supplies to power the LEDs. An LED fixture may be made with a form factor that allows it to replace a standard fixture or bulb. LEDs can also be used in place of florescent lights as backlights for displays.

For most LED lamps, LEDs may be selected to provide various light colors to combine to produce light output with a high color rendering index (CRI). The desired color mixing may be achieved, for example, using blue, green, amber, red and/or red-orange LED chips. One or more of the chips may be in a package with a phosphor or may otherwise have a locally applied phosphor. Translucent or transparent rigid materials may be used with LED lighting fixtures to provide diffusion, color mixing, to otherwise direct the light, or to serve as an enclosure to protect the LEDs. Such rigid materials serve as optical elements external to the LED modules themselves. Such optical elements may allow for localized mixing of colors, collimate light, and provide the minimum beam angle possible. Such optical elements may include reflectors, lenses, and/or lens plates. Reflectors can be, for example, of the metallic, mirrored type, in which light reflects of opaque silvered surfaces, or be made of or use white or near-white highly reflective material. Lenses can vary in complexity and level of optical effect, and can be or include traditional lenses, total internal reflection optics, or glass or plastic plates with or without coatings or additives.

SUMMARY

Embodiments of a lighting system and an example light fixture are disclosed herein. The lighting system includes LED devices on a mounting surface positioned proximate to a back reflector. In example embodiments, the heatsink radiates heat up from the top of the system and the LED light source emits light downward. The fixture can be a troffer style fixture, which takes a form similar to commercial fixtures using fluorescent tubes. The system or fixture can have a lens arrangement included lenses, lens plates or sections with differing optical characteristics, including one that passes and diffuses some light from the LED light source, but reflects some light back to the back reflector.

A lighting system according to some embodiments of the invention includes a back reflector and a plurality of LED devices centrally disposed at the back reflector. The centrally disposed LED devices emit light into a lens arrangement including a partially reflective section opposite the plurality of LED devices and at least one translucent lens section. In some embodiments the LED devices are placed on a mounting surface of a heatsink. In some embodiments, the partially reflective section of the lens arrangement is a lens plate with reflective filler, for example, an acrylic base resin plate with titanium dioxide filler. In some embodiments the translucent lens section includes two translucent lens plates on opposing sides of the lens plate with the reflective filler.

In some embodiments of the lighting system, the lens plate with the reflective filler receives light from the plurality of LED devices over 85 to 105 degrees of an angular light pattern. In some embodiments, the lens plate with the reflective filler receives light from the plurality of LED devices over about 94 degrees of an angular light pattern.

In some embodiments, the LED devices include two groups of LEDs, wherein one group, if illuminated, would emit light having a dominant wavelength from 435 to 490 nm, and another group, if illuminated, would emit light having a dominant wavelength from 600 to 640 nm. One group can be packaged with a phosphor, which, when excited, emits light having a dominant wavelength from 540 to 585 nm or from 560 to 580 nm.

In some embodiments, one group if illuminated would emit light having a dominant wavelength from 440 to 480 nm, and the other group, if illuminated, would emit light having a dominant wavelength from 605 to 630 nm. In some embodiments, the light emitted has a color rendering index (CRI) of at least 90.

In example embodiments of the invention, the lighting system is used in a light fixture including a support structure to which the reflector can be fixed or connected. In some embodiments the reflector includes at least two curved regions. The support structure and reflector can also be a single part. The inner surface of the reflector can face downward. The LED mounting surface on the heatsink can also face downward. In at least some embodiments a pan is also connected to or formed as part of the support structure.

A light fixture according to example embodiments of the invention can be assembled by providing a support structure including the reflector with an inner reflective surface facing downward relative to the intended mounting orientation for the light fixture. The heatsink with the plurality of LEDs can be installed proximate to the reflector so as to be disposed centrally relative to the light fixture. A partially reflective lens can be made by use of an appropriate filler, for example, titanium dioxide. The partially reflective lens can then be positioned opposite the plurality of the LED devices and a translucent lens lenses can be installed adjacent to the partially reflective lens. All lenses could also be positioned together as a single part. The pan can also be attached to the support structure of the light fixture.

BRIEF DESCRIPTION OF THE DRAWINGS

FIG. 5 shows the view that one would see when looking up at the fixture from a room.

DETAILED DESCRIPTION

Figure 1:
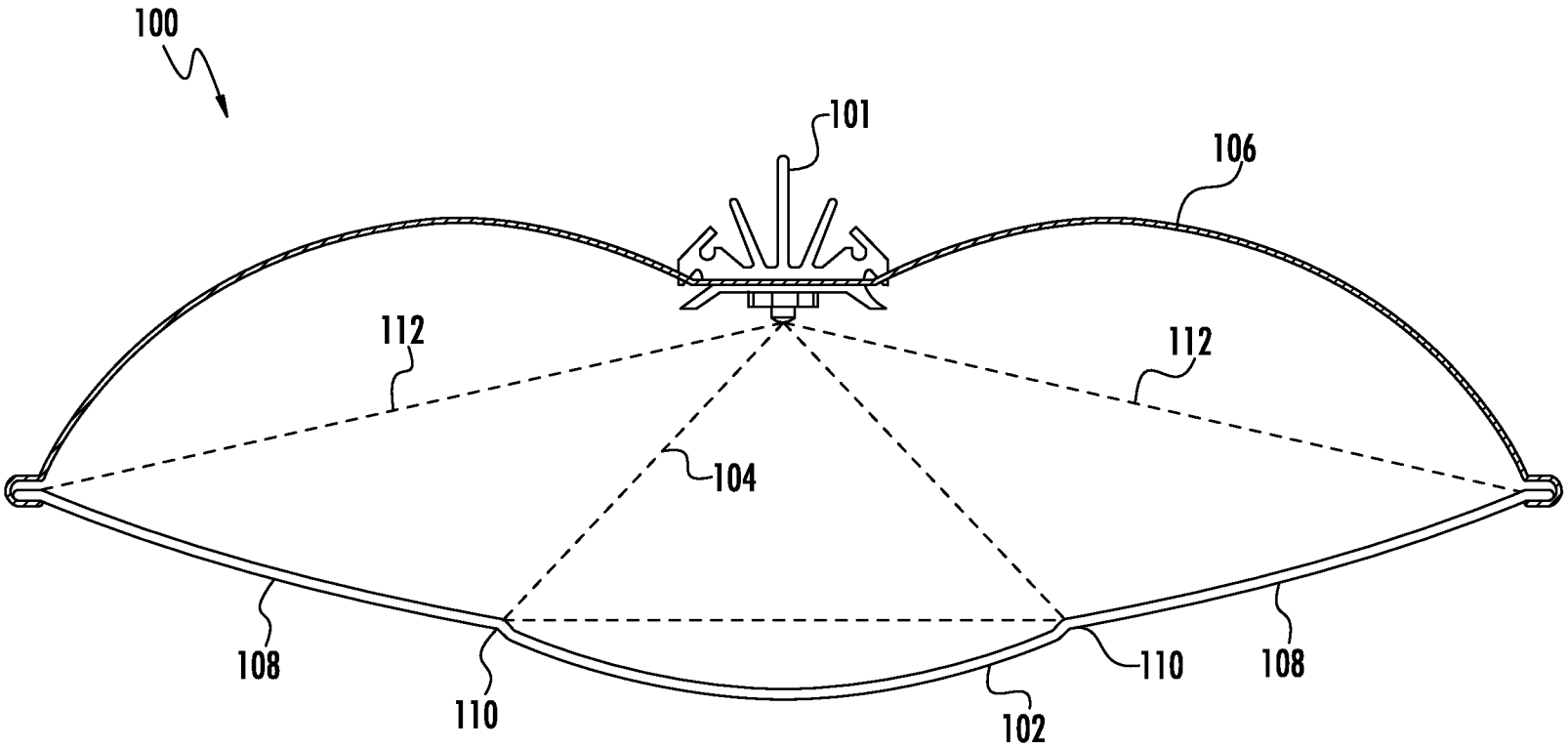
FIG. 1 is a cross-sectional view of a lighting system or "light engine" according to an example embodiment of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

An example light fixture embodying an example lighting system as disclosed herein includes LED devices as the light source positioned on a mounting surface of a heatsink, wherein the mounting surface is positioned at or near the top of a back reflector and the heatsink radiates heat up from the top of the fixture. The fixture can be a troffer style fixture, which takes a form similar to commercial fixtures using fluorescent tubes. Such a fixture might be used as a solid-state replacement for a standard fluorescent light fixture, and/or might be of a form factor to be placed in the space normally occupied by drop ceiling tiles in an office environment, and/or be designed to hang below a ceiling on stanchions, posts or chains. The system includes a lens arrangement with sections that serve to diffuse light received directly from the LED light source and light reflected by the back reflector, and a section that passes and diffuses some light from the LED light source, but reflects some light back to the back reflector. In some embodiments, the section of the lens arrangement that diffuses light can include two lens plates disposed at the sides of a lens plate that is more reflective. Either or both of these lens plates may be optically translucent and may be referred to as a diffuser. The more reflective lens plate serves as the partially reflective section.

Thus, a light fixture according to example embodiments of the invention may include a back reflector, a plurality of LED devices centrally disposed at the back reflector, and a lens arrangement including a partially reflective section opposite the plurality of LED devices and at least one translucent lens section. In some embodiments, the back reflector includes at least two curved regions. In some embodiments these curved regions are parabolic in shape. In some embodiments, a heatsink is provided with a mounting surface for the plurality of LED devices. The LED devices may be mounted on a circuit board which is in turn secured to the mounting surface of the heatsink. In some embodiments the partially reflective section of the lens arrangement comprises a lens plate with reflective filler.

Figure 2:
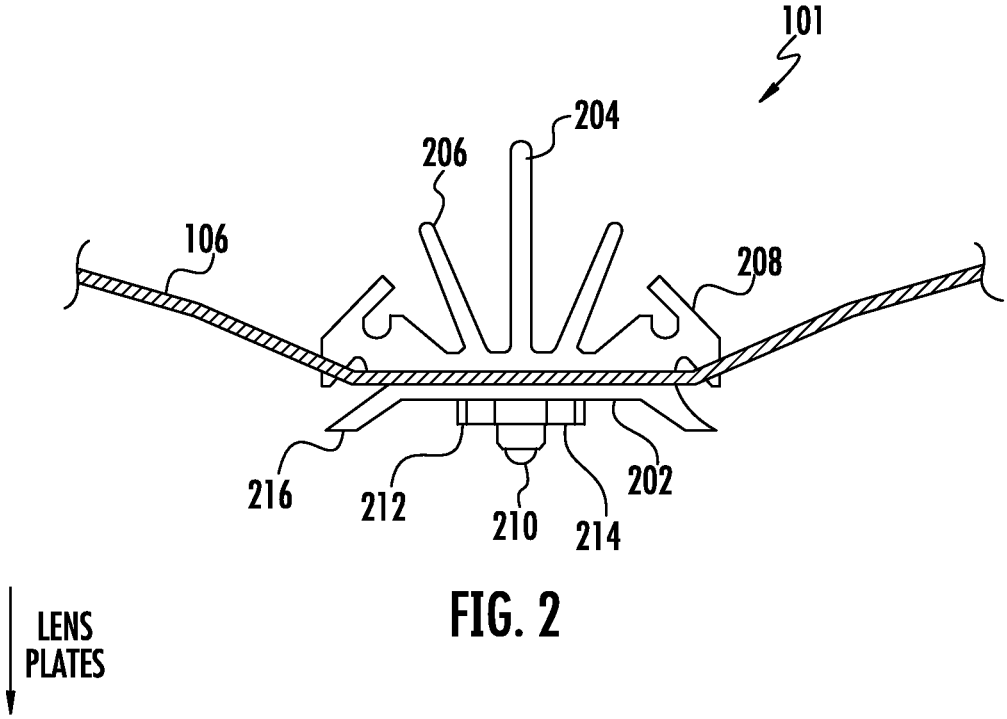
FIG. 2 is a magnified cross sectional view of the heatsink area of the lighting system of the embodiment of FIG. 1.

FIG. 1 is a cross-sectional view of the lighting system according to example embodiments of the invention. This lighting system might also be referred to as a "light engine" because it primarily includes the light generating and optical components of a fixture. Lighting system 100 includes LED devices placed in a line or strip on the mounting surface of heatsink 101. Further details of the heatsink portion of lighting system 100 are illustrated in FIG. 2, discussed later in this disclosure. Lighting system 100 uses different types of material properties in different sections of a lens arrangement in order to achieve a balance of good color mixing, uniformity, and efficacy. The center section 102 may be referred to as a partially reflective section, or a "white" section of the lens arrangement. Center section 102 in this example is illuminated by central light triangle 104 and can, as an example, include an acrylic base resin and loaded with reflective filler, such as titanium dioxide ($TiO_2$). This composition will give a translucent "white" appearance to this portion of the lens arrangement, which can serve to hide the LEDs and the heatsink from view.

Still referring to FIG. 1, back reflector 106 receives the portion of light reflected from center section 102 of the lens arrangement. Depending on the loading of the reflective additive in lens section 102, the amount of light allowed through the center section vs. the amount of light reflected back into the back reflector can be varied. The higher the loading, the higher the reflectivity and hiding power, but also the higher the optical loss. The loading of reflective additive into the center section is balanced with the distance from the LEDs at the top of the reflector chamber in order to provide maximum efficacy along with the best aesthetics. Cutting the distance between the LEDs and the lens arrangement in half will require between 2× and 4× the reflectivity of the center panel, depending on the characteristics desired. The balance will be non-uniformity in the center section (which will increase exponentially at the same loading) vs. optical efficiency (which will decrease linearly with increased $TiO_2$ loading). The closer the LEDs, the more intensity will be apparent on the lens. Therefore it may be desirable to have less light bleed through; otherwise the increased intensity will be visible as either more non-uniformity or higher surface luminance for the center lens section.

Still referring to FIG. 1, outboard portions or sections 108 may be referred to as translucent lens or diffuser sections. Sections 108 can be constructed of clear acrylic base resin with transparent, differential index of refraction additive such as Arkema™ DR66080, other large-molecule PMMAs, alumina or other transparent ceramics, which provide a clear translucent lens plate capable of high optical efficiency. These outboard lens plates can be separate components mechanically or chemically connected to the center section at points 110, or the entire lens arrangement can be coextruded/co-molded with the center section and outboard sections together.

As previously described, center section 102 of the lens arrangement shown in FIG. 1 receives light from the LED light source through central light triangle 104. In example embodiments, central light triangle defines a cross-section of a conceptual, approximately 94-degree cone, that is, a cone whose sides occur at angles 47 degrees to either side of a conceptual vertical center line. Thus, it can be stated that the central lens plate 102 receives light over about 94 degrees of the angular light pattern presented by the LED light source. In various embodiments, the central lens plate can receive light over from about 85 to about 105 degrees of the angular light pattern presented by the LED light source.

Staying with FIG. 1, as most LEDs have a 100-120 degree full-width-half-max ("FWHM") light pattern, the intensity of the light from the LEDs is reduced by almost 50% where the LED light hits the inboard edges of more clear translucent sections 108 of the lens arrangement for lighting system 100. In various embodiments, the outboard edge of the angular light pattern may occur from anywhere from about 60 to about 90 degrees from vertical center, with the inboard edge being coincident with the edge of the central light triangle, or from about 42 to about 53 degrees from vertical center.

In the particular embodiment illustrated in FIG. 1, the outboard edge of the light pattern striking the translucent lens plates on opposing sides of the central plate is defined by lines 112 which occur at about 76 degrees from vertical center. The remaining high angle light bounces off the curved, possibly parabolic, back reflector in the back chamber.

The back reflector 106 of lighting system 100 of FIG. 1, in example embodiments, can be a diffuse white reflector. It should be appreciated that the distance between the LED board and the lens system can be varied to affect the ratio of light that impinges on the more reflective center section vs. the amount of light that impinges on the outboard, more transparent or translucent diffusive sections of the lens arrangement.

FIG. 2 is a close-up, cross-sectional view of the heatsink area of the example lighting system of FIG. 1, in which the heatsink and light source are visible in some detail. It should be understood that FIG. 2 provides an example only as many different heatsink structures could be used with an embodiment of the present invention. The orientation of the heatsink relative to a lens plates is indicated. The mounting surface 202 of heatsink 101 faces the interior cavity of the light engine. Heatsink 101 includes a fin structure 204 and two each of fin structures 206 and 208. The mounting surface 202 provides a substantially flat area on which LED devices 210 can be mounted for use as a light source. In this particular example embodiment, LED devices 210 are mounted on a circuit board 212 with wiring channels 214 to provide for connection of the LEDs inside the LED device packages. The LED devices 210 can be mounted to face orthogonally to the mounting surface 202 to face the center region of lens arrangement of the light engine, or they may be angled if the lens arrangement is designed to accommodate the resulting light pattern. In some embodiments, a baffle 216 may be included. The baffle 216 reduces the amount of light emitted from the LED devices at high angles that may escape the cavity without being reflected. It should be noted that a heatsink suited for use with an embodiment of the invention can take any of many different shapes.

Figure 3:
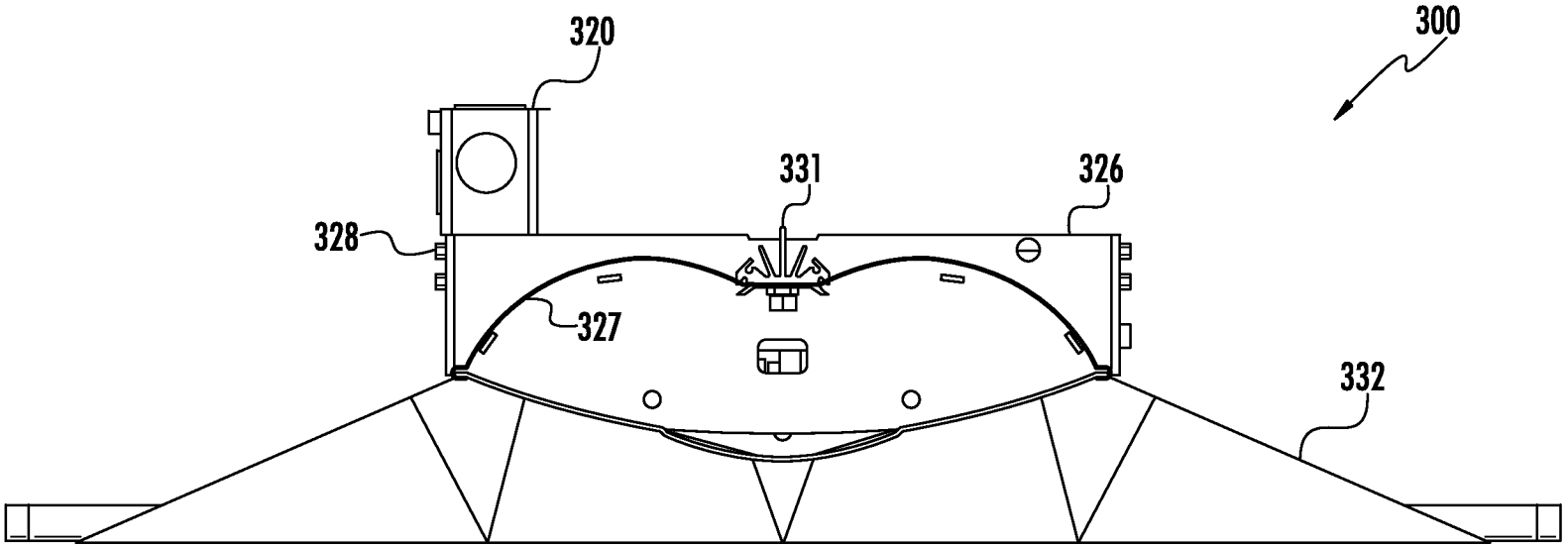
FIG. 3 is a cross-sectional view of an embodiment of a light fixture that makes use of the lighting system according to example embodiments of the invention.

FIG. 3 illustrates a cross-sectional view of a complete light fixture 300 according to example embodiments of the invention. L-shaped circuit box 320 is attached to a portion of support structure 326 of the light fixture. The outline of back reflector 327 is also visible. Various screws such as sheet metal screw 328 can be used to hold the parts of the fixture together. The support structure and/or the circuit box can include various mounting holes and slots to accommodate various assembly options. Circuit box 320 houses electronics used to drive and control the light sources such as rectifiers, regulators, timing circuitry, and other components. Wiring from the circuit box to the light sources can be passed through the circuit board on heatsink 331 as previously described. Pan 332 is sized to fit around the light engine and within a space of one or two ceiling tiles of a typical office drop ceiling. The fixture could also be designed to be suspended on stanchions. Pan 332 could take any of various sizes and shapes.

Figure 4:
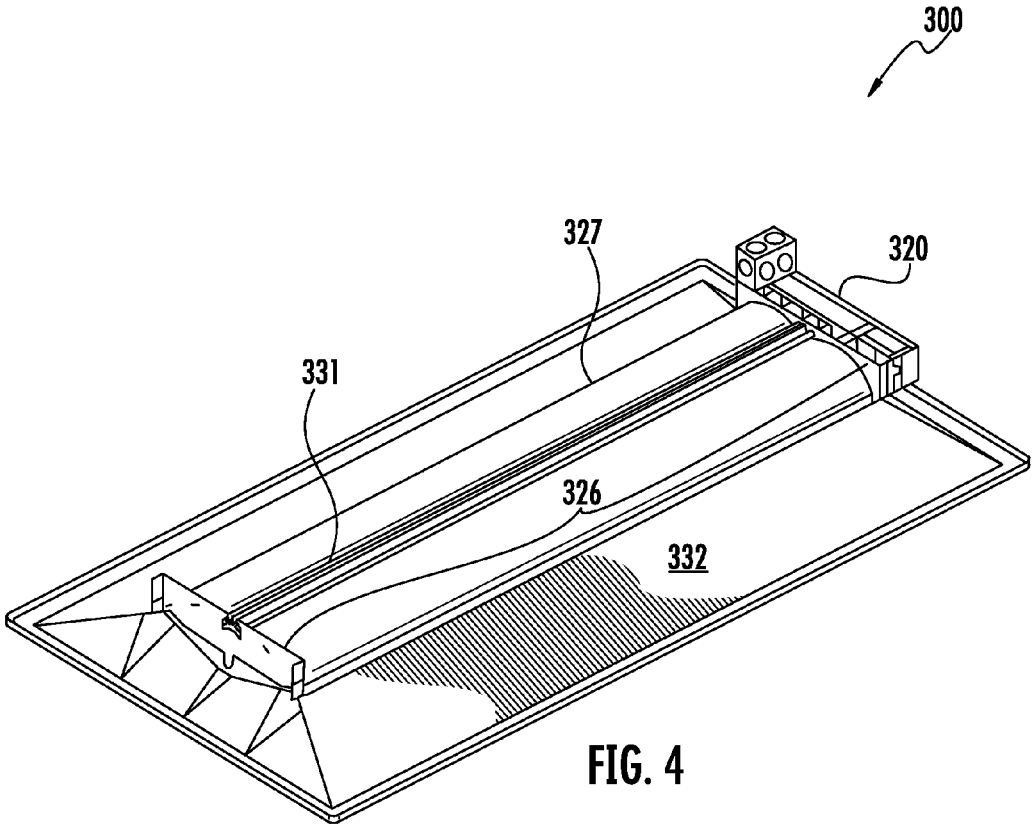
FIG. 4 is a top view of the embodiment of the light fixture that is illustrated in FIG. 3.
Figure 5:
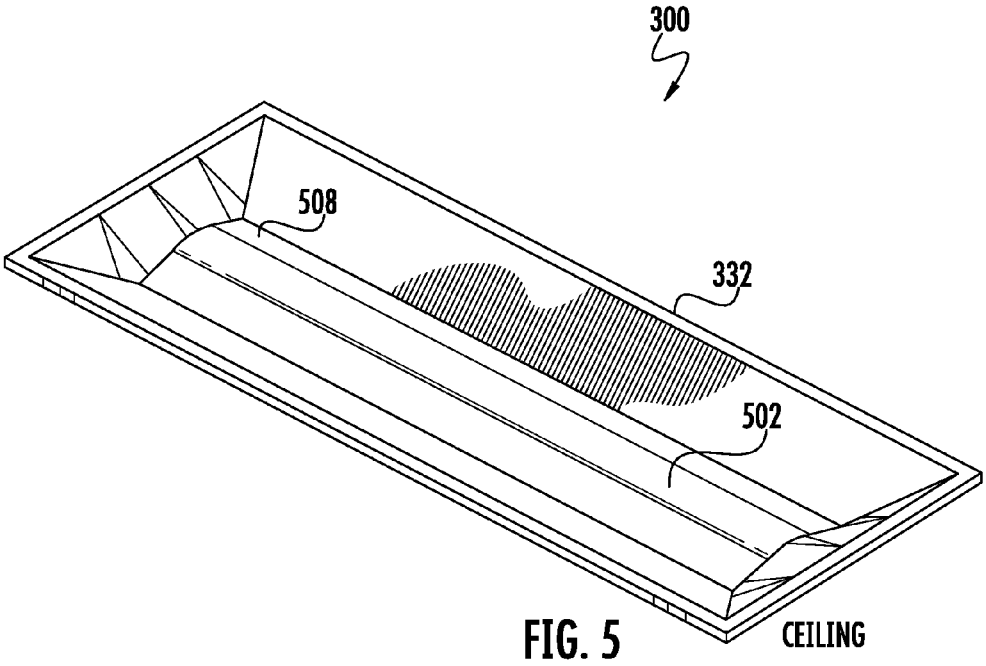
FIG. 5 is a bottom view of the embodiment of the light fixture illustrated in FIGS. 3 and 4. More specifically.

FIGS. 4 and 5 illustrate the completed light fixture in a top perspective view and a bottom perspective view, respectively. In the top view of FIG. 4, heatsink 331 for the LED strip can be seen running down the length of the fixture between the two curved sections of back reflector 327. Again, the back reflector of the fixture may be designed to have any of various shapes to perform particular optical functions, such as color mixing and beam shaping, for example. In this example the back reflector includes two curved side regions. More particularly in this example, the side regions are parabolic. The support structure 326 in this embodiment of the fixture includes a metal plate on each end of back reflector 327. L-shaped circuit box 320 is fastened to one of the metal plates. Support structure 326 is an example only. Many different types of support structures could be used, including an entire outer housing covering the back reflector. In such a case, thermal considerations may dictate that such a housing includes an opening for the heatsink. The support structure for the fixture can be made of any of various materials including metal such as steel or aluminum, and plastic. The back reflector can be coated with or made of reflective material such as a microcellular polyethylene terephthalate (MCPET). Other white reflective materials can also be used.

It should be noted that the heatsink shown in the figures provides an example only as many different heatsink structures could be used with an embodiment of the present invention. The fin structures of heatsink 331 in FIG. 4 radiate heat into the ceiling cavity when the fixture is mounted in a drop ceiling or into the air space between the fixture and the ceiling when the fixture is hung on stanchions.

FIG. 5 is a bottom perspective view of the example fixture 300 mounted in a ceiling, which is also indicated in the figure. Pan 332 is sized and shaped to replace a number ceiling tiles, depending on the tile size. In this view the partially reflective section, or a "white" section or lens plate 502 of the lens arrangement is visible. Outboard portions, sections, or lens plate 508 are also visible. Because troffer style light fixtures are traditionally used in large areas populated with modular furniture, such as in an office for example, many fixtures can be seen from anywhere in the room. Specification grade fixtures often include mechanical shielding in order avoid too much direct light and thus provide a "quiet ceiling" and a more comfortable work environment. In some embodiments, the pan is sized and shaped to provide a primary cutoff of the light coming through lens plates to provide such mechanical shielding, while also providing mechanical support for the back reflector and heatsink of the fixture.

A multi-chip LED package used with an embodiment of the invention and can include light emitting diode chips that emit hues of light that, when mixed, are perceived in combination as white light. Phosphors can also be used. Blue or violet LEDs can be used in the LED assembly of a lamp and the appropriate phosphor can be deployed on a carrier within the fixture. The back reflector of the fixture could also be coated with a phosphor to provide remote wavelength conversion. LED devices can be used with phosphorized coatings packaged locally with the LEDs to create various colors of light. For example, blue-shifted yellow (BSY) LED devices can be used with a red phosphor on or in a carrier or on the back reflector to create substantially white light, or combined with red emitting LED devices on the heatsink to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED services include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. Each of the former, blue LEDs are packaged with a phosphor that, when excited, emits light having a dominant wavelength from 560 to 580 nm, so as to form a blue-shifted-yellow LED device. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

The various parts of an LED lamp according to example embodiments of the invention can be made of any of various materials. Heatsinks can be made of metal or plastic, as can the various portions of the housings for the components of a lamp. A lamp according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lighting system comprising:

a back reflector having a length;

a plurality of LED devices for emitting light disposed adjacent the back reflector and extending in an elongated strip for substantially the length of-the back reflector, the plurality of LEDs facing away from the back reflector;

an at least partially optically transmissive lens arrangement, the lens arrangement being substantially coextensive with the back reflector to define an interior space with the back reflector such that light emitted by each of the plurality of LED devices is mixed in the interior space and is at least partially reflected off of the back reflector and is emitted from the lighting system through the lens arrangement, the lens arrangement including an elongated, centrally disposed, partially reflective section that extends along the elongated strip of the plurality of LED devices and is disposed opposite to the plurality of LED devices to receive light emitted by the plurality of LED devices, and at least two elongated, translucent sections disposed along opposing sides of the partially reflective section, the at least two elongated, translucent sections extending for the length of the partially reflective section to receive light emitted by the plurality of LED devices wherein the partially reflective section receives light from 85 to 105 degrees of an angular light pattern presented by the plurality of LED devices; and a reflective filler in the partially reflective section so that the partially reflective section is more reflective than the translucent sections and allows some light to pass through and reflects some light to the back reflector wherein loading of the reflective filler in the partially reflective section is based on the distance of the plurality LED devices from the lens arrangement.

2. The lighting system of claim 1 further comprising a heatsink with a mounting surface for the plurality of LED devices.

3. The lighting system of claim 2 wherein the partially reflective section of the lens arrangement comprises a lens plate with the reflective filler.

4. The lighting system of claim 3 wherein the lens plate comprises acrylic base resin and the reflective filler comprises titanium dioxide.

5. The lighting system of claim 1 wherein each of the at least two translucent sections includes an inboard edge from about 42 to about 53 degrees from a vertical center of the lighting system.

6. The lighting system of claim 1 wherein the partially reflective section receives light from about 94 degrees of the angular light pattern presented by the plurality of LED devices.

7. The lighting system of claim 1 wherein the plurality of LED devices further comprises at least two groups of LEDs, wherein one group, if illuminated, would emit light having a dominant wavelength from 435 to 490 nm, and another group, if illuminated, would emit light having a dominant wavelength from 600 to 640 nm, one group being packaged with a phosphor, which, when excited, emits light having a dominant wavelength from 540 to 585 nm.

8. The lighting system of claim 7 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

9. The lighting system of claim 1 wherein the lighting system is operable to emit light with a color rendering index (CRI) of at least 90.

10. A light fixture comprising:

a support structure;

a reflector connected to the support structure, the reflector reflecting light over substantially its entire interior surface;

a heatsink proximate to the reflector disposed centrally relative to the light fixture, the heatsink comprising a mounting surface;

a lens arrangement opposite the reflector;

a plurality of LEDs mounted to the mounting surface in an elongated strip and disposed in the interior space;

the lens arrangement being substantially coextensive with the back reflector such that the lens arrangement and the reflector define an interior space, the lens arrangement being at least partially optically transmissive across the interior space such that light emitted by each of the plurality of LEDs is mixed in the interior space and is emitted from the lighting system through the lens arrangement, the lens arrangement including an elongated, partially reflective section that extends along the elongated strip and is disposed opposite to the plurality of LED devices, the partially reflective section defining opposing sides that extend parallel to the elongated strip, and an elongated, translucent section disposed along each of the opposing sides of the partially reflective section, the elongated, translucent sections extending for the length of the partially reflective section wherein the partially reflective section receives light from 85 to 105 degrees of an angular light pattern presented by each of the plurality of LEDs; and the partially reflective lens section being more reflective than the translucent sections and allowing some light to pass through and reflecting some of the received light to the reflector.

11. The light fixture of claim 10 further comprising a pan surrounding the reflector.

12. The light fixture of claim 11 wherein the reflector further comprises at least two curved regions.

13. The light fixture of claim 10 wherein the elongated, partially reflective section receives light from about 94 degrees of the angular light pattern presented by the plurality of LEDs.

14. The light fixture of claim 10 wherein the light fixture is operable to emit light with a color rendering index (CRI) of at least 90.

15. The light fixture of claim 10 wherein the plurality of LEDs further comprises at least two groups of LEDs, wherein one group, if illuminated, would emit light having a dominant wavelength from 435 to 490 nm, and another group, if illuminated, would emit light having a dominant wavelength from 600 to 640 nm, one group being packaged with a phosphor, which, when excited, emits light having a dominant wavelength from 540 to 585 nm.

16. The light fixture of claim 15 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

17. The light fixture of claim 10 wherein the elongated, partially reflective section comprises a lens plate with the reflective filler.

18. The light fixture of claim 17 wherein the lens plate comprises acrylic base resin and the reflective filler comprises titanium dioxide.

19. The light fixture of claim 17 each of the at least two translucent sections includes an inboard edge from about 42 to about 53 degrees from a vertical center of the lighting system.

20. A method of assembling a light fixture, the method comprising:

providing a support structure including a reflector with an inner reflective surface, the reflector reflecting light over substantially the entire inner reflective surface;

installing a heatsink proximate to the reflector so as to be disposed centrally relative to the light fixture, the heatsink comprising a mounting surface;

mounting a plurality of LEDs, the plurality of LEDs being disposed in an elongated strip on the mounting surface such that the plurality of LEDs are thermally coupled to the heat sink, the plurality of LEDs facing away from the inner reflective surface; and positioning a lens arrangement comprising an elongated, partially reflective lens and two elongated translucent lenses such that the lens arrangement and the reflector define an interior space, the lens arrangement being substantially coextensive with the reflective surface and being at least partially optically transmissive across the interior space such that light emitted by each of the plurality of LEDs is mixed in the interior space and is at least partially reflected off of the inner reflective surface and is emitted from the lighting system through the lens arrangement, configuring the lens arrangement such that the partially reflective lens extends along the elongated strip and is disposed opposite the plurality of the LEDs and one of the two translucent lenses disposed along opposing sides of the partially reflective lens, wherein the partially reflective lens is more reflective than the two translucent lenses and allows some light to pass through and reflects some light to the inner reflective surface, and wherein, the two translucent lenses extend for the length of the partially reflective lens and the partially reflective lens receives light from 85 to 105 degrees of an angular light pattern presented by each of the plurality of LEDs.

21. The method of claim 20 further comprising attaching a pan to at least one of the support structure and the reflector.

22. The method of claim 21 further comprising providing the partially reflective lens in the form of a lens plate.

23. The method of claim 22 wherein the partially reflective lens comprises a reflective filler, the reflective filler comprises titanium dioxide.

24. The method of claim 20 further comprising placing the plurality of LEDs on the heatsink in at least two groups of LEDs, wherein one group, if illuminated, would emit light having a dominant wavelength from 435 to 490 nm, and another group, if illuminated, would emit light having a dominant wavelength from 600 to 640 nm, one group being packaged with a phosphor, which, when excited, emits light having a dominant wavelength from 540 to 585 nm.

25. The method of claim 24 wherein the one group, if illuminated, would emit light having a dominant wavelength from 440 to 480 nm, and the other group, if illuminated, would emit light having a dominant wavelength from 605 to 630 nm, one group being packaged with a lumiphor, which, when excited, emits light having a dominant wavelength from 560 to 580 nm.

* * * * *